United States Patent [19]

Filippini et al.

[11] Patent Number: 4,565,582

[45] Date of Patent: Jan. 21, 1986

[54] LACTULOSE PURIFICATION PROCESS

[75] Inventors: Andrea Filippini, Prato; Renato Carobbi, Pistoia, both of Italy

[73] Assignee: SIRAC S.p.A., Milan, Italy

[21] Appl. No.: 631,105

[22] Filed: Jul. 16, 1984

[30] Foreign Application Priority Data

Mar. 22, 1984 [IT] Italy ..... 20176 A/84

[51] Int. Cl.[4] ..... C13D 3/12

[52] U.S. Cl. ..... 127/46.1

[58] Field of Search ..... 127/30, 31, 46.1, 46.2, 127/46.3

[56] References Cited

U.S. PATENT DOCUMENTS

| | | | |
|---|---|---|---|
| 3,505,309 | 4/1970 | Carubelli | 127/46.1 |
| 3,546,206 | 12/1970 | Guth et al. | 127/30 |
| 3,562,012 | 2/1971 | Reinicke et al. | 127/46.1 |
| 3,716,408 | 2/1973 | Nagasawa et al. | 127/46.1 |
| 3,816,174 | 6/1974 | Nagasawa et al. | 127/30 |
| 3,864,166 | 2/1975 | Barker et al. | 127/46.1 |

FOREIGN PATENT DOCUMENTS 865594 4/1961 United Kingdom .

OTHER PUBLICATIONS

Yurkevich et al., "Study of the Interaction of Polyols with Polymers Containing N-Substituted [(4-Boronophenyl)Methyl]-Ammonio Groups", *Carbohydrate Research,* 43 (1975), pp. 215-224.

*Primary Examiner*—Ivars Cintins

*Attorney, Agent, or Firm*—Stevens, Davis, Miller & Mosher

[57] ABSTRACT

A process for purifying lactulose from other carbohydrates, in particular from lactose and galactose, by passing a lactulose syrup through one or more columns containing a bifunctionalized boron resin of the type:

(I)

in which (P) is a polyacrylic or polystyrene polymer matrix and R, $R^1$, $R^2$, $R^3$, X are as defined in the text.

By passing the lactulose solution containing carbohydrate impurities through a boron resin (I) of polyacrylic matrix, the lactulose is selectively retained and is subsequently released by elution with an acid solution.

The small quantity of galactose which may still be contained in the lactulose-enriched solution can be removed by passing said solution through a boron resin (I) of polystyrene matrix, which selectively retains the galactose.

7 Claims, 2 Drawing Figures

LACTULOSE PURIFICATION PROCESS

Figure 1:
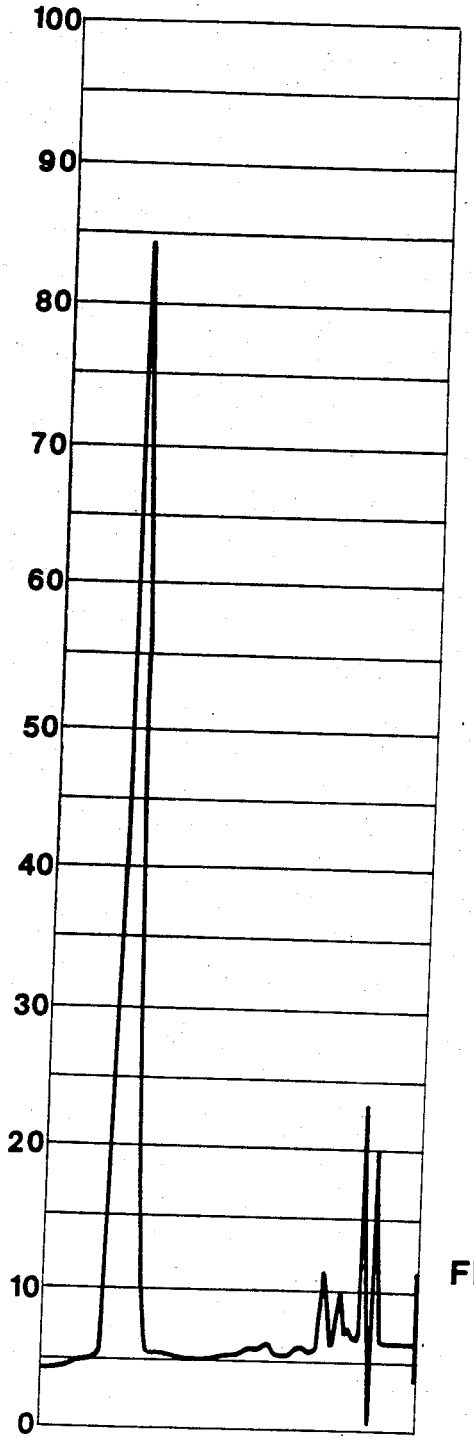

This invention relates to a new process for purifying lactulose by passing syrups which contain it through resins having a variable affinity for carbohydrates which depends on the pH, polarity and ionic force characteristics of the medium.

More particularly, the present invention relates to a new process of industrial application for purifying lactulose syrups from other carbohydrates, in particular from lactose and galactose, by passage over bifunctionalized boron resins.

Lactulose is a synthetic disaccharide used in the form of a syrup or crystalline product in the treatment of intestinal affections and hepatic malfunctions.

Commercially available lactulose syrup is generally not pure, but contains more or less high quantities of other carbohydrates, particularly lactose and galactose.

A typical composition of syrup currently available commercially is as follows:

| | |
|---|---|
| Lactulose | 50% by weight |
| Galactose | 4–8% by weight |
| Lactose | 4–8% by weight |
| Other carbohydrates | 5–10% by weight |

and thus contains relatively high percentage of other carbohydrates. These carbohydrates are also present in the commercially available crystalline lactulose, but generally to a lesser extent. These extraneous carbohydrates are undesirable in the therapeutic applications for which the lactulose is used.

There is therefore a requirement for lactulose in the form of syrup or crystals, which is of much higher purity and in which the content of extraneous carbohydrates is reduced by the greatest possible extent.

The main lactulose purification processes known up to the present time are based either on selective absorption on known ion exchange resins or on the controlled oxidation of the syrup with bromine in order to convert the galactose and lactose into the corresponding aldonic acids, which are then removed by treatment with normal ion exchange resins.

A purification process of the first type is described for example in French Pat. No. 2,117,558, in which the separation process is conducted by feeding the lactulose syrup over an ion exchange resin of bisulphite or sulphite type.

Processes of this type have not found industrial application mainly because of their time requirement and cost. In any case, these processes never result in high purification.

The second type of purification is described for example in U.S. Pat. No. 3,372,705 and in British Pat. No. 865,594, in which the lactulose syrup is treated with bromine chemically or electrochemically in order to oxidize the aldoses. The oxidize syrup is then passed over resins. The syrups obtained by this process always have a purity which is too low.

It is also known to use boron resins in separating carbohydrates, but only in chromatographic analytical methods (Carbohydrate Research, 43, 1975, 215–224). The boron resins used in these processes are very unstable both chemically and mechanically.

We have now discovered the subject matter of the present invention, namely a new lactulose purification process which can be conducted on an industrial scale and which enables lactulose to be obtained practically free from other carbohydrates, and in particular practically free from lactose and galactose, in a simple and economical manner.

The lactulose purification process according to the present invention consists essentially of passing a lactulose syrup containing 10–50% of lactulose and 10–50% of other hydrocarbons through one or more columns containing a boron resin of the type

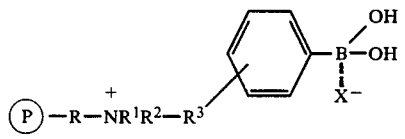

(I)

in which (P) is a polyacrylic or polystyrene matrix

R and $R^3$, which can be the same or different, are $-(CH_2)_n-$ where n is between 0 and 5

$R^1$ and $R^2$, which can be the same or different, are $C_1$–$C_5$ alkyl $X^-$ is an anion chosen from the group consisting of hydroxyl and halides.

The process according to the present invention is further characterized in that the boron resin of formula (I) with a polyacrylic matrix selectively retains the lactulose, whereas most of the other carbohydrates and in particular the lactose and galactose are removed by elution with an aqueous mobile phase, generally demineralized water; the lactulose is then released from the resin by treatment with an aqueous acid solution of pH less than or equal to 5.

A further characteristic of the process according to the present invention is the completely unexpected fact that when the boron resin of formula (I) has a polystyrene matrix it selectively and quantitatively retains galactose, whereas it has no affinity for lactulose. It has therefore been found that by passing a resultant solution of high lactulose content over the boron resin of formula (I) having a polystyrene matrix obtained from passage over a boron resin with a polyacrylic matrix, it is possible to remove any galactose residue from this resultant solution and thus from the lactulose.

The characteristics of the process according to the invention and its advantages over the processes of the known art will be more apparent from the description given hereinafter of a preferred embodiment of the invention.

The resins used for the process according to the present invention are boron resins of the type defined heretofore by means of formula (I), having a polyacrylic or polystyrene matrix. Said resins can be of various types, such as gel, macroporous or microporous, and can have different degrees of cross-linking by different cross-linking agents, and are preferably resins with the following characteristics: degree of functionalization between 1 and 8 meq B/g of dry resin, and preferably between 2 and 4;

B content between 1 and 8%;

$-N(CH_3)_2$ groups between 2 and 9 meq/g of dry resin;

degree of cross-linking between 2 and 15%;

average pore diameter between 500 and 1500 Å;

specific surface area between 4 and 40 $m^2/g$;

real density between 1.0 and 1.5 g/ml;

apparent density between 0.5 and 1.1 g/ml;

particle size between 0.1 and 0.7 mm.

The boron resin of polyacrylic matrix is submerged in demineralized water at ambient temperature for a period of about 8 hours in order to cause it to swell, generally to up to 4–5 times its initial volume.

The resin is then loaded into a column.

The aqueous solution to be purified is concentrated to a carbohydrate concentration of between 5% and 40% by weight, and preferably between 8% and 30% by weight.

The proportion of resin volume to the weight quantity of the solution to be treated depends on the degree of functionalization of the resin and on the solution concentration. The preferred proportion, expressed as liters of resin to kilograms of carbohydrates contained in the fed solution is between 1/0.3 and ½.

The lactulose solution is passed through the resin at a specific throughput preferably of between 0.5 and 3 bv/h at a temperature of between 5° and 65° C., and elution is then effected with an aqueous solution of pH between 4.5 and 8.5, generally until neutral, and if necessary under hot conditions, with a volume ratio with respect to the lactulose solution preferably of between 3 and 5.

By successive elution with water, a carbohydrate solution strongly enriched in impurities, in particular lactose and galactose, and practically free from lactulose, is removed from the column.

The column is then eluted with a solution made weakly acid, preferably with hydrochloric acid or acetic acid, by means of which the lactulose-enriched carbohydrate mixture remaining absorbed on the resin is displaced.

The lactulose-enriched solution which is displaced by means of the acid mobile phase is obtained as a neutral solution in that the acid is consumed by the resin buffer effect, so that the solution can be utilized as such for any subsequent treatment.

The resin is regenerated by washing with demineralised water, followed by treatment with an alkaline solution and then with demineralized water until neutral.

The solution enriched in impurities which was obtained by elution with water can be treated in a second column in which the described process is repeated.

The two solutions originating from the elution by means of the acid solution, namely the treatment in the first and second columns respectively, can be pooled and if necessary passed through a third equal column in which the treatment already effected in the two preceding columns is repeated.

Generally the solution originating from the acid elution in the second or third column can contain between 0 and 2% of galactose, and is completely free from lactulose.

If required by virtue of the specific use for which the lactulose is intended, the small residual quantity of galactose can be totally eliminated by passing over a boron resin of formula (I) of polystyrene matrix, which totally absorbs the galactose and only traces of lactulose, and allows the pure lactulose to be practically totally eluted with water.

The pure lactulose solutions obtained by the process according to the present invention can be used as such or suitably concentrated, or the lactulose can be crystallized by known methods, for example by concentration under vacuum or by precipitation with ethanol.

The boron resins used in the new process are new resins which form the subject matter of a patent application filed on the same date.

Illustrative but non-limitative examples are given hereinafter of the purification process for lactulose syrups according to the present invention.

EXAMPLE 1

A boron resin of polyacrylic matrix having the following characteristics:

degree of functionalization 3.5 meq B/g of dry resin;
B content 4%;
ammonium groups 7 meq/g of dry resin;
degree of cross-linking 4%;
average pore diameter 1000 Å;
specific surface area 10 $m^2/g$;
apparent density 0.7 g/ml;
real density 1.3 g/ml;
particle size 0.2–0.4 mm (75%);
is submerged in demineralized water at ambient temperature for a period of 8 hours in order to cause it to swell.

200 ml of resin obtained in this manner are loaded into a column of diameter 26 mm.

This column is fed over 90 minutes with 400 ml of a carbohydrate solution containing 32 g of lactulose, 64 g of lactose and 4 g of galactose. 500 ml of solution (A1) containing 12 g of lactulose, 61 g of lactose and 3 g of galactose are obtained by elution with distilled water. By further elution with a 1N HCl solution, 250 ml of solution (A2) are obtained containing 20 g of lactulose, 3 g of lactose and 1 g of galactose.

A solution (A1) is passed through a second column of diameter 26 mm filled with 100 ml of resin equal to that used in the first column.

By elution with deionized water, 600 ml of solution (B1) are obtained containing 4 g of lactulose, 59 g of lactose and 2 g of galactose. By further elution with a 1N HCl solution, 120 ml of solution (B2) are obtained containing 8 g of lactulose, 1.5 g of lactose and 0.8 g of galactose.

Solutions (A2) and (B2) are pooled and passed through a third column of diameter 26 mm filled with 100 ml of resin equal to that used in the first two columns.

By elution with deionised water, 400 ml of a solution (C1) are obtained containing 18 g of lactulose, 5 g of lactose and 1.5 g of galactose. Further elution with a 1N HCl solution gives 100 ml of solution (C2) containing 10 g of lactulose and 0.3 g of galactose, the solution being completely free from lactose.

Solution (C2) can be treated in a column with boron resin of polystyrene matrix in order to totally eliminate the galactose, or can be concentrated or crystallised to give the required product, whereas solution (B1) is discarded and solution (C1) is recycled to the column containing 100 ml of acrylic resin.

The HPLC (high pressure liquid chromatography) characteristics of solution (C2) are shown in FIG. 1, compared with the characteristics (FIG. 2) of a solution obtained by purifying an equal initial lactulose solution by treatment with bromine and by passage over resin using the conventional method.

The HPLC chromatograms were effected under the following conditions:

column: diameter 4 mm, length 250 mm;
filling: Lichrosorb $NH_2$ (10 microns);
column temperature: 40±0.5° C.;
detector: UV spectrophotometer—reading at 192 nm;
mobile phase: 20% of 0.01M aqueous monobasic potassium phosphate solution in acetonitrile;
throughput: 2.5 ml/min;

loop: 20 μl.

Figure 2:
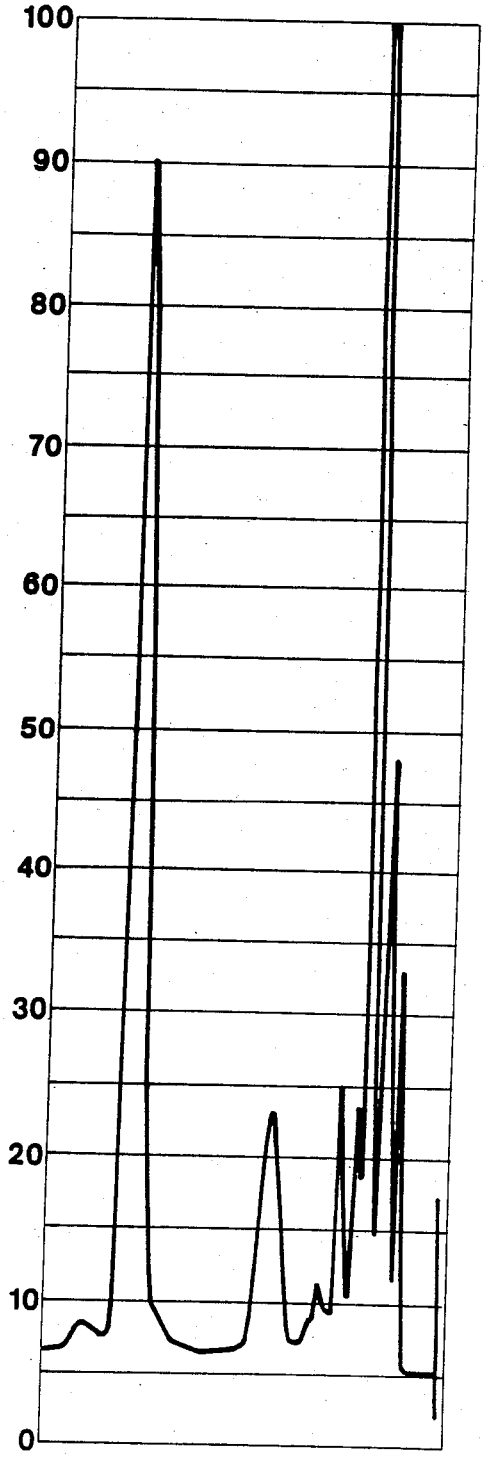

From the accompanying chromatograms it can be seen clearly that the lactulose syrup produced in accordance with the invention (FIG. 1) is completely free from galactose and lactose, but that these are present in the syrup purified by the conventional method, as shown by the clearly visible peaks B and C (FIG. 2).

EXAMPLE 2

A boron resin of polyacrylic matrix, possessing the characteristics given in Example 1, is swollen by the described method. 100 ml of resin obtained in this manner are loaded into a column of 26 mm diameter.

This column is fed over 60 minutes with 52 ml of a lactulose syrup solution (lactulose 50% by weight, lactose 4% by weight, galactose 4.5% by weight, other sugars 7% by weight), diluted 1 to 2 with water made alkaline such that the final solution has a pH of 8. By elution with a mobile phase at the same pH, 200 ml of solution (A1) are obtained containing 33.8 g of non-retained sugars, comprising 29 g of lactulose, 3.2 g of lactose and 1.6 g of galactose. By then eluting the column with a 1N HCl solution, 150 ml of solution (A2) are obtained containing 10 g of lactulose, 0.2 g of galactose and no lactose.

Solution (A2) can either be treated in a column with a boron resin of polystyrene matrix in order to totally eliminate the galactose, or be concentrated and/or crystallised to obtain pure lactulose syrup or crystals. Solution (A1) can be recycled to the same acrylic resin column.

EXAMPLE 3

Solution (C2) of Example 1 and solution (A2) of Example 2 are used for obtaining crystalline lactulose in the following manner: the lactulose solution to be crystallised is fed into a 250 ml flask fitted with a mechanical agitator, thermometer and condenser. It is evaporated to dryness under vacuum at a maximum temperature of between 35° and 40° C. The residue is taken up 2–3 times in 25 ml of absolute ethanol, each time evaporating to dryness under vacuum in order to remove the water. Absolute ethanol is then added in the proportion of 4 ml/g of lactulose present, and the mixture boiled under reflux for 3 hours. After this time the formation of small product crystals is observed, and these are enlarged by suitable agitation at 60° C. for 4 hours.

The mixture is cooled, filtered, the crystals washed with a little pre-cooled solvent and dried in a oven for 3 hours at 50° C. under vacuum, to obtain a crystallization yield of 90%.

The purity of the crystalline lactulose obtained in this manner is 99.2% on HPLC analysis.

We claim:

1. a process for purifying lactulose from other carbohydrates, comprising: passing an aqueous lactulose solution containing 5–40% of carbohydrates through one or more columns containing a bifunctionalized boron resin of the formula

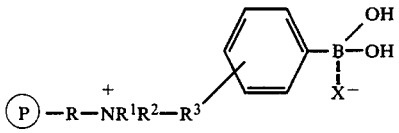

(I)

in which (P) is a polyacrylic or polystyrene matrix

R and $R^3$, are the same or different, and have the formula $—(CH_2)_n—$ wherein n is between 0 and 5

$R^1$ and $R^2$ are the same or different, and have the formula $C_1$–$C_5$ alkyl and $X^-$ is an anion selected from the group consisting of hydroxyl and halides.

2. The process as claimed in claim 1, wherein the resin functionalization is between 1 and 8 meq of B and between 2 and 9 meq of ammonium groups per g of dry resin.

3. The process as claimed in claim 1, wherein the lactulose is selectively retained by passing the lactulose solution through a boron resin of formula (I) of polyacrylic matrix.

4. The process as claimed in claim 3, wherein the lactulose retained by the resin is released from said resin by eluting with an aqueous acid solution, of pH less than or equal to 5, to produce a lactulose-rich solution.

5. The process as claimed in claim 4, wherein galactose is selectively retained by passing the eluted lactulose-rich solution through a boron resin of general formula (I) of polystyrene matrix.

6. The process as claimed in claim 1, wherein the ratio of the volume of resin in liters contained in the column to the quantity of carbohydrates in kilograms contained in the fed solution lies between 1:0.3 and 1:2.

7. The process as recited in claim 1 wherein said other carbohydrates are lactose and galactose.

* * * * *